US010195481B2

(12) United States Patent
Ban

(10) Patent No.: US 10,195,481 B2
(45) Date of Patent: Feb. 5, 2019

(54) STRETCH EXERCISE TOOL

(71) Applicant: NCC CO., LTD., Aichi (JP)

(72) Inventor: Toshiki Ban, Aichi (JP)

(73) Assignee: NCC Co., Ltd., Aichi (JP)

( * ) Notice: Subject to any disclaimer, the term of this patent is extended or adjusted under 35 U.S.C. 154(b) by 0 days.

(21) Appl. No.: 15/509,699

(22) PCT Filed: Aug. 26, 2015

(86) PCT No.: PCT/JP2015/073943
§ 371 (c)(1),
(2) Date: Mar. 8, 2017

(87) PCT Pub. No.: WO2016/039137
PCT Pub. Date: Mar. 17, 2016

(65) Prior Publication Data

US 2017/0252606 A1 Sep. 7, 2017

(30) Foreign Application Priority Data

Sep. 9, 2014 (JP) ..... 2014-182909

(51) Int. Cl.
*A63B 23/02* (2006.01)
*A61H 1/02* (2006.01)
*A63B 23/00* (2006.01)

(52) U.S. Cl.
CPC ..... *A63B 23/02* (2013.01); *A61H 1/0296* (2013.01); *A61H 2201/0153* (2013.01);
(Continued)

(58) Field of Classification Search
CPC ..... A61H 1/0296; A61H 2201/1695; A61H 2201/1284; A61H 2201/0153;
(Continued)

(56) References Cited

U.S. PATENT DOCUMENTS 2,219,624 A * 10/1940 Dixon ..... A61H 15/00 297/271.6
4,867,142 A * 9/1989 Jones ..... A61H 1/0229 482/907

(Continued)

FOREIGN PATENT DOCUMENTS

JP S62-174551 U 11/1987
JP 3015234 U 8/1995
JP 2012-016396 A 1/2012

OTHER PUBLICATIONS

Search Report issued in corresponding International Patent Application No. PCT/JP2015/073943, dated Nov. 17, 2015.

*Primary Examiner* — Megan Anderson
(74) *Attorney, Agent, or Firm* — McDermott Will & Emery LLP

(57) ABSTRACT

Provided is a stretch exercise tool whereby muscles around the vertebrae can be uniformly extended. A stretch exercise tool provided with a stretching part the upper face of which projects into a crest type along the longitudinal direction and on which a user's body is placed with facing upward and extended, wherein the stretching part is configured of multiple body-supporting ribs in the width direction, said ribs being disposed along the longitudinal direction. According to this configuration, when the user's body is placed on the stretching part, a force in the longitudinal direction, said force acting to topically extend the body, is applied to the body at each interval among the ribs. Thus, the body can be uniformly extended compared with the conventional configurations.

10 Claims, 11 Drawing Sheets

(52) U.S. Cl.
CPC ..... *A61H 2201/1284* (2013.01); *A61H 2201/1695* (2013.01); *A61H 2203/0431* (2013.01); *A61H 2203/0456* (2013.01); *A61H 2205/081* (2013.01); *A61H 2205/088* (2013.01); *A63B 2023/006* (2013.01)

(58) Field of Classification Search
CPC ..... A61H 2205/081; A61H 2205/088; A61H 2203/0456; A61H 2203/0431; A63B 23/02; A63B 2023/006
See application file for complete search history.

(56) References Cited

U.S. PATENT DOCUMENTS

| | | | | |
|---|---|---|---|---|
| 5,713,816 | A | 2/1998 | Glover | |
| 5,931,769 | A * | 8/1999 | Nunez | A61H 1/0292 482/121 |
| 7,134,988 | B2 * | 11/2006 | Van Straaten | A63B 23/0211 482/142 |
| 2011/0040219 | A1 * | 2/2011 | Tanner | A61H 1/0292 601/128 |
| 2013/0079690 | A1 * | 3/2013 | Chen | A61H 1/005 601/134 |
| 2015/0045707 | A1 * | 2/2015 | Selvaggio | A61H 15/0092 601/118 |

* cited by examiner (a)
4h
4g
4f
4e
4d
4c
4b
4a
4i
4k
4j
1
(b)
4a
5a
3
(c)
4b
5b
(d)
4c
5c
(e)
4d
5d
(f)
4e
5e
(g)
4f
5f
5f
(h)
4g
5g
5g
(i)
4h
5h
5h
(j)
4i
5i
5i
(k)
5j
4j
5j
(l)
4k
5k
5k

STRETCH EXERCISE TOOL

CROSS REFERENCE

This application is the U.S. National Phase under 35 U.S.C. § 371 of International Application No. PCT/JP2015/073943, filed on Aug. 26, 2015, which claims the benefit of Japanese Application No. 2014-182909, filed on Sep. 9, 2014, the entire contents of each are hereby incorporated by reference.

TECHNICAL FIELD

The present invention relates to a stretch exercise tool equipped with a stretching part curving and projecting into a crest shape on which the neck, the back, the waist, etc. is placed to cause muscle around vertebrae to be extended, thereby producing an effect of correcting a user's posture, etc.

BACKGROUND ART

The conventionally known stretch exercise tool is equipped with a stretching part curving and projecting into a crest shape along a longitudinal direction, on which a user places his neck, back, or waist, while lying on his back, to extend muscle around vertebrae, thereby producing an effect of correcting the user's posture, etc. (e.g., Patent Literature 1).

CITATION LIST

Patent Literature

PATENT LITERATURE 1: Japanese Patent Application Publication 2012-16396

SUMMARY OF INVENTION

Technical Problem

In the stretch exercise tool of the above-mentioned Patent Literature 1, muscle around vertebrae can be extended by causing the neck, the back, the waist, etc. to curve along the curved shape of the stretching part. However, such stretch exercise tool cannot uniformly extend a body part placed on the stretching part. This is because hardness of body is not even and thus, when a force in a direction for extending the body part placed on the stretching part is applied, a flexible stretching body part extends earlier than an inflexible unstretching body part, thereby hindering sufficient extending of the inflexible body part.

The present invention was made to solve the above described problem. A purpose of the present invention is to provide a stretch exercise tool capable of uniformly extending muscles around vertebrae.

Solution to Problem

The present invention is directed to a stretch exercise tool equipped with a stretching part, an upper face of which curves and projects into a crest shape along a longitudinal direction and on which a user's body is placed lying on the back for extending the body, wherein the stretching part is configured of a plurality of ribs arranged in the longitudinal direction and expanding in a width direction for supporting the body.

In such configuration, when the user's body is placed on the stretching part, because the plurality of ribs presses a back side of the body at intervals in the longitudinal direction, a force acting to extend an interval between body parts pressed by the neighboring two ribs in a longitudinal direction is topically applied. Therefore, in the present invention, a force acting to extend a body part placed on the stretching part at each interval among the ribs is applied. Accordingly, the inflexible body part and the flexible body part can be extended individually. Therefore, the configuration of the stretch exercise tool of the present invention realizes effective extending of the inflexible body part in comparison with the conventional configurations. Thus, the body part placed on the stretching part can be extended uniformly.

In the present invention, proposed is the number of ribs of 5 to 15. According to a study of the inventor, when the number of ribs is less than 5, a distance between ribs becomes too wide, which makes it difficult to apply an extending force focusing to an inflexible body part. Further, when the number of ribs is 16 or more, because a load of body disperses among many ribs, a force pressing the body by a single rib becomes small and thus an extending force acting on each interval among ribs becomes insufficient.

Further, in the present invention, proposed is such a configuration that the ribs have an approximately V-shape when viewed from the front. In such configuration, because a valley part extending in the longitudinal direction is formed throughout a center part of the width direction of the stretching part and the valley part is positioned facing to a body part of less muscle right behind vertebrae, the ribs would not hurt the body by directly stimulating the back of the vertebrae. Further, the ribs having an approximately V-shape when viewed from the front serve not only to press the body upwards but also to press the body in such a manner that the back side of the body is sandwiched from both sides to press the body inwardly and upwardly. Therefore, the extending force in the longitudinal direction can be efficiently transferred to muscle around the vertebrae positioned through the center of the body.

Still further, in the present invention, proposed is such a configuration further equipped with a base seat curving and projecting into a crest shape along the longitudinal direction, wherein each rib is formed of a set of right and left finger-like resilient parts symmetrically extending to upper left and upper right from a center part of the width direction of an upper face of the base seat.

In such configuration, when a body is placed on the stretching part, the ribs formed into an approximately V-shape by the sets of right and left finger-like resilient parts are deflected to be expanded to a right and left direction due to a load of body. Therefore, the ribs can strongly press the muscle around the vertebrae inwardly from the both sides by a restoring elastic force of the deflected finger-like resilient parts. This realizes efficient extending of the muscle around the vertebrae.

Further, in the above described configuration, it is proposed that the finger-like resilient parts are curved into an arc-shape loosely inclined toward the tip sides thereof when viewed from the front.

Further, in such configuration, as the approximately V-shaped ribs are deflected to be expanded to the right and left direction due to the load of body, steeply inclined base side parts of the finger-like resilient parts support the body. Therefore, it becomes possible to bring the body to contact with the approximately V-shaped ribs always at a proper angle apart from a deflecting amount of the finger-like resilient parts. This enables to cause the extending force in the longitudinal direction to properly act on the body.

Still further, in the above described configuration, it is proposed that the finger-like resilient parts forming ribs disposed on a center portion of the longitudinal direction are steeply inclined when viewed from the front in comparison with the finger-like resilient parts forming the ribs disposed on a front side portion and on a rear side portion of the longitudinal direction.

Since the ribs disposed on the center portion of the longitudinal direction are positioned on top of the stretching part, a larger load is applied thereto when the body is placed on the stretching part in comparison with a load applied to the ribs disposed on the front side portion and the rear side portion. This makes the ribs disposed on the center portion deflect to expand largely to the right and left direction. Consequently, alike such configuration, if the finger-like resilient parts constituting the ribs disposed on the center portion are steeply inclined when viewed from the front, a contact angle between the approximately V-shaped ribs and the body can be maintained within a proper range with ease even when the finger-like resilient parts of the center portion are deflected largely due to the load.

Still further, in the above described configuration, it is proposed that the finger-like resilient parts forming the ribs disposed on the front side portion are inclined forward and the finger-like resilient parts forming the ribs disposed on the rear side portion are inclined rearwards.

In such configuration, the finger-like resilient parts (ribs) of the front side portion are deflected to be inclined further forward and the finger-like resilient parts (ribs) of the rear side portion are deflected to be inclined further rearwards, respectively, due to the load at the time when the body is placed on the stretching part. This enables further extending of the body in the longitudinal direction of the stretching part.

Incidentally, the stretch exercise tool of the present invention is used for extending muscles of the neck (cervical vertebra), the back (thoracic vertebra), the waist (lumber vertebra), etc. It is, however, desirable that the stretch exercise tool used for extending the neck, the stretch exercise tool used for extending the back, and the stretch exercise tool used for extending the waist are formed in such a manner that a size and a shape of the respective stretching parts are suitably formed adapted to the shapes of the object body parts (the neck, the back, the waist), respectively, without departing from the spirit of the present invention.

Advantageous Effects of Invention

As described above, the configuration of the stretch exercise tool of the present invention can extend the muscles around the vertebrae uniformly in comparison with the conventional configurations.

DESCRIPTION OF EMBODIMENTS

An embodiment of the present invention will be described below referring to the below exemplary embodiment.

The stretch exercise tool 1 of the present embodiment is equipped thereon with a stretching part 2 that curves and projects into a crest shape along a longitudinal direction as illustrated in FIGS. 1 to 5. The stretching part 2 is composed of 11 ribs 4*a* to 4*k* arranged in parallel one another in a longitudinal direction, the ribs expanding in a width direction.

Figure 1:
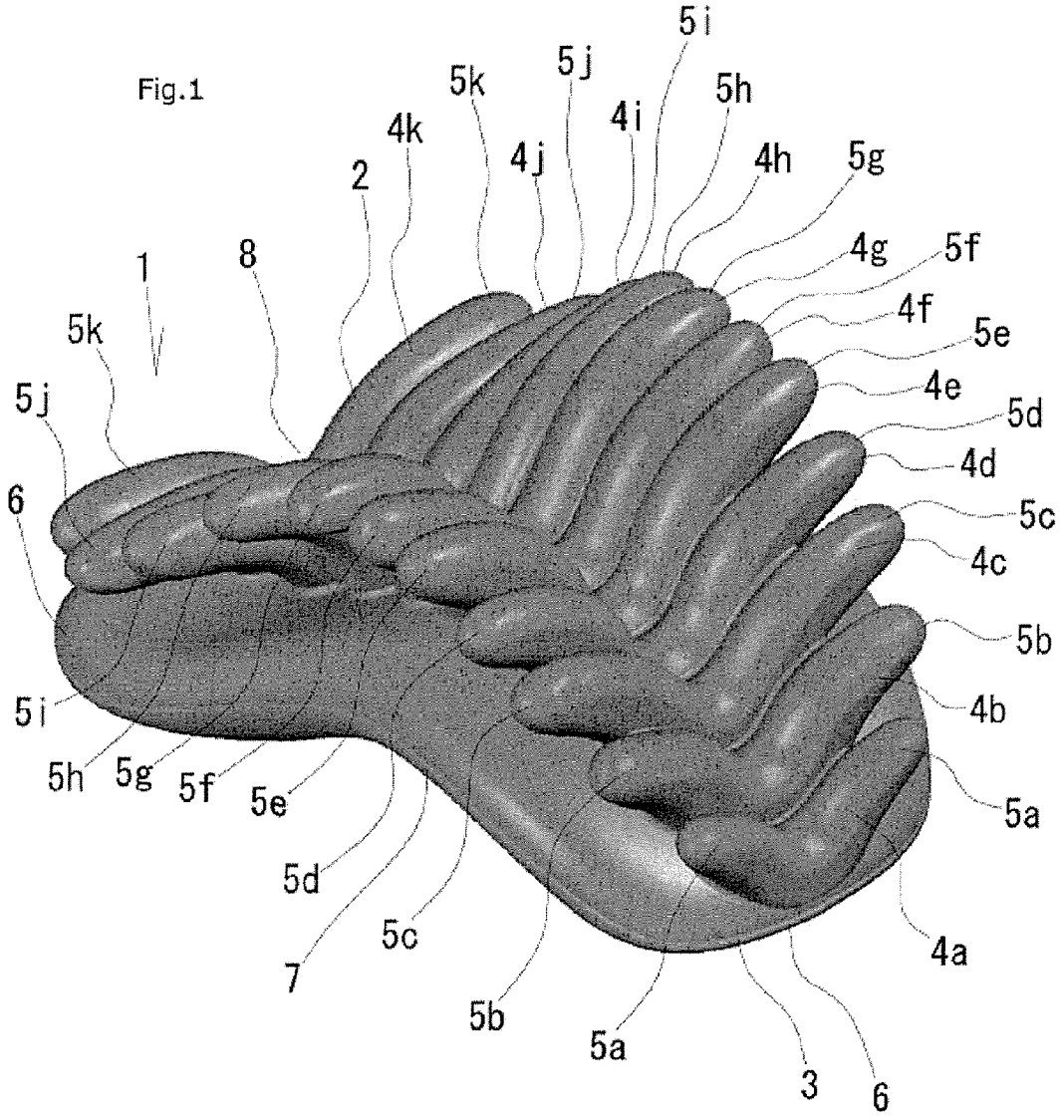
FIG. 1 is a perspective view illustrating a stretch exercise tool 1 when viewed from the front.
Figure 2:
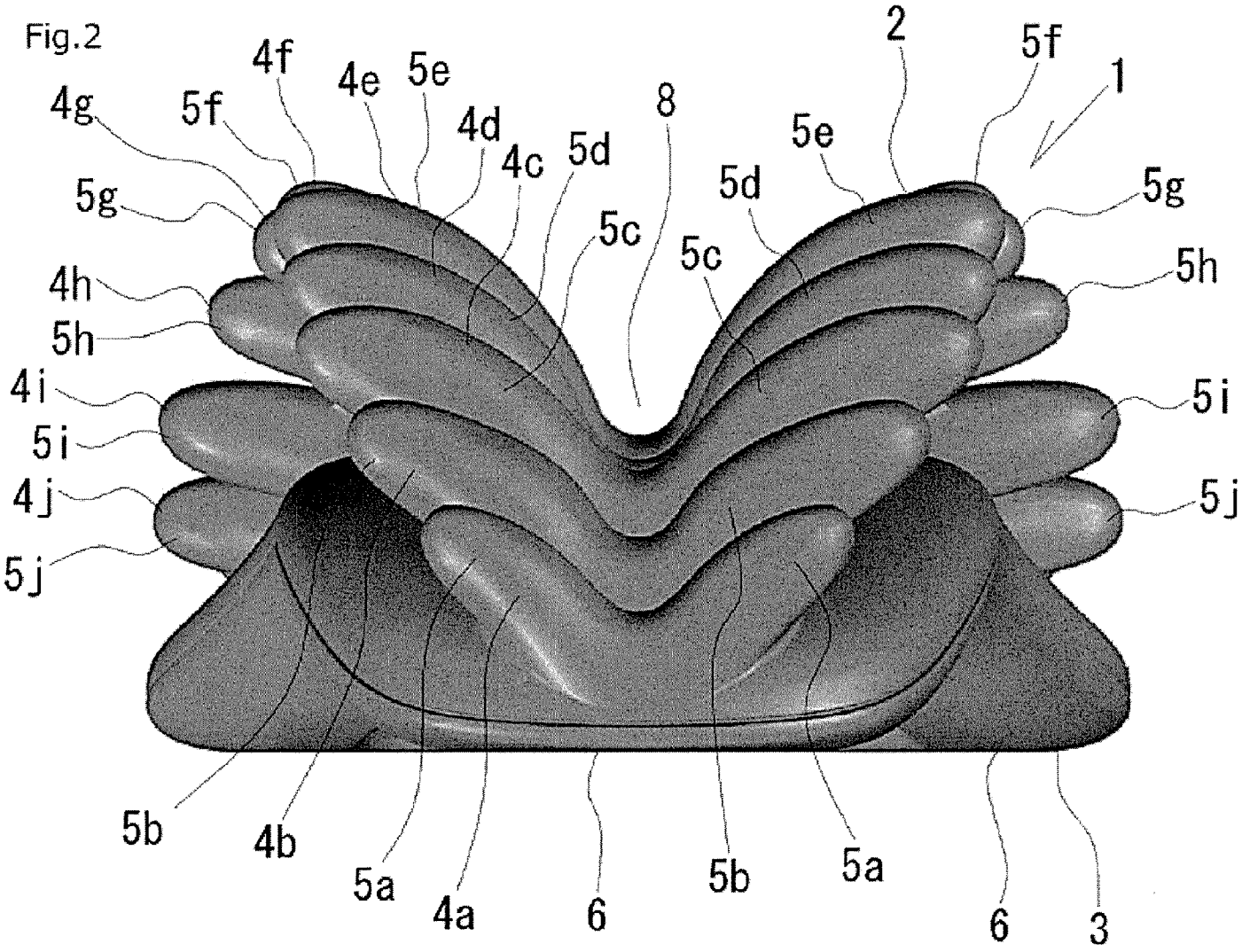
FIG. 2 is a front view of the stretch exercise tool 1.
Figure 3:
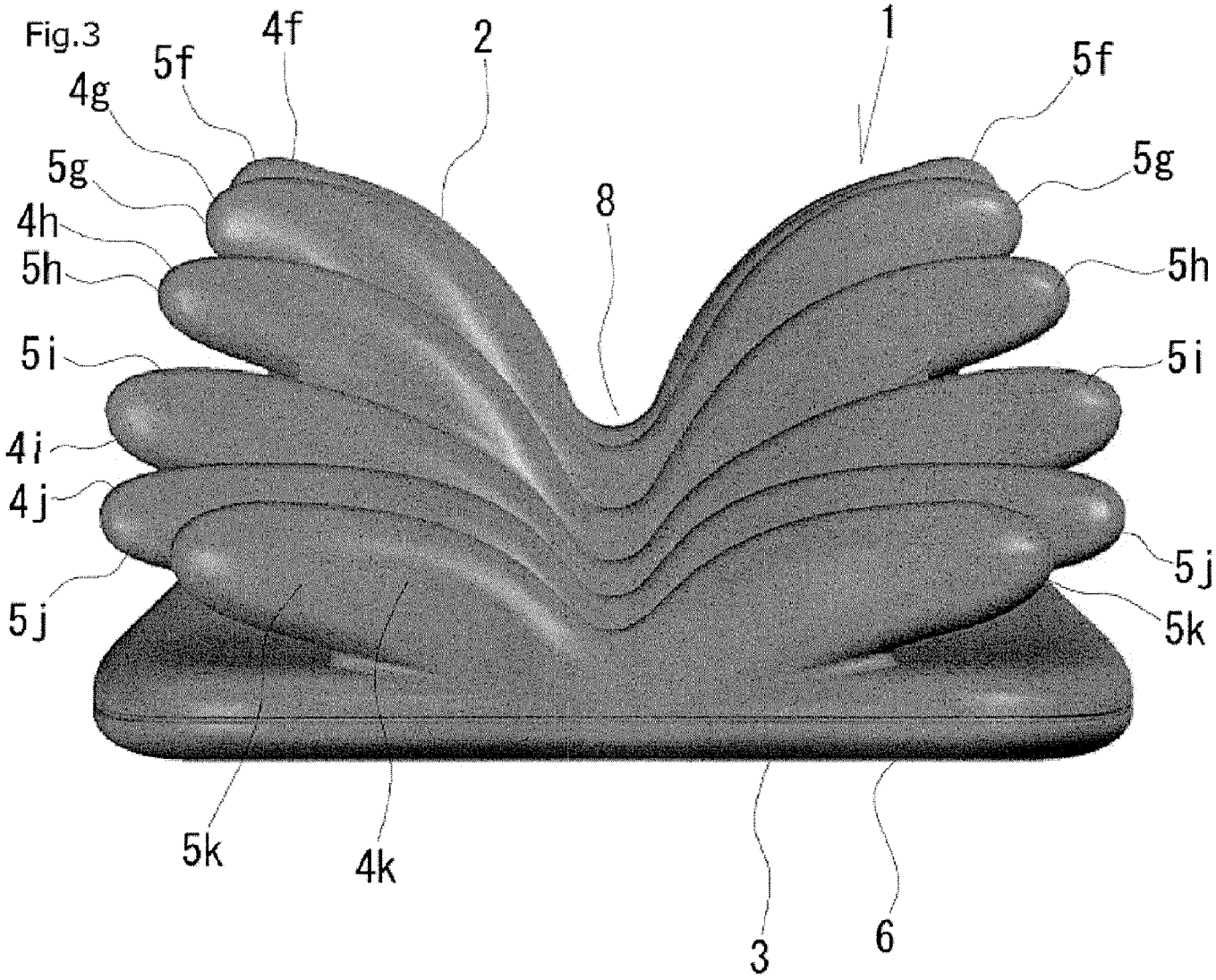
FIG. 3 is a rear view of the stretch exercise tool 1.
Figure 4:
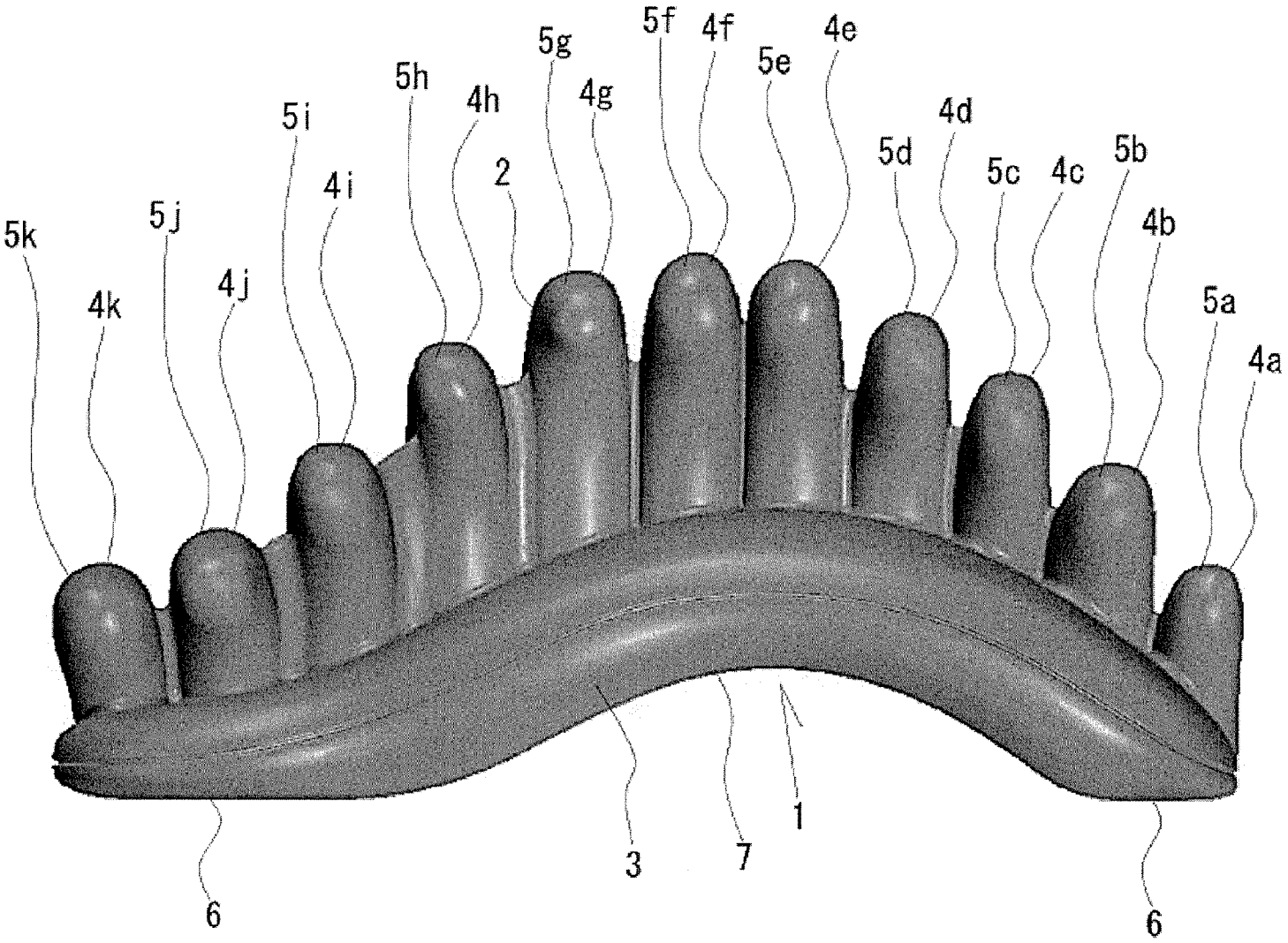
FIG. 4 is a side view of the stretch exercise tool 1.
Figure 5:
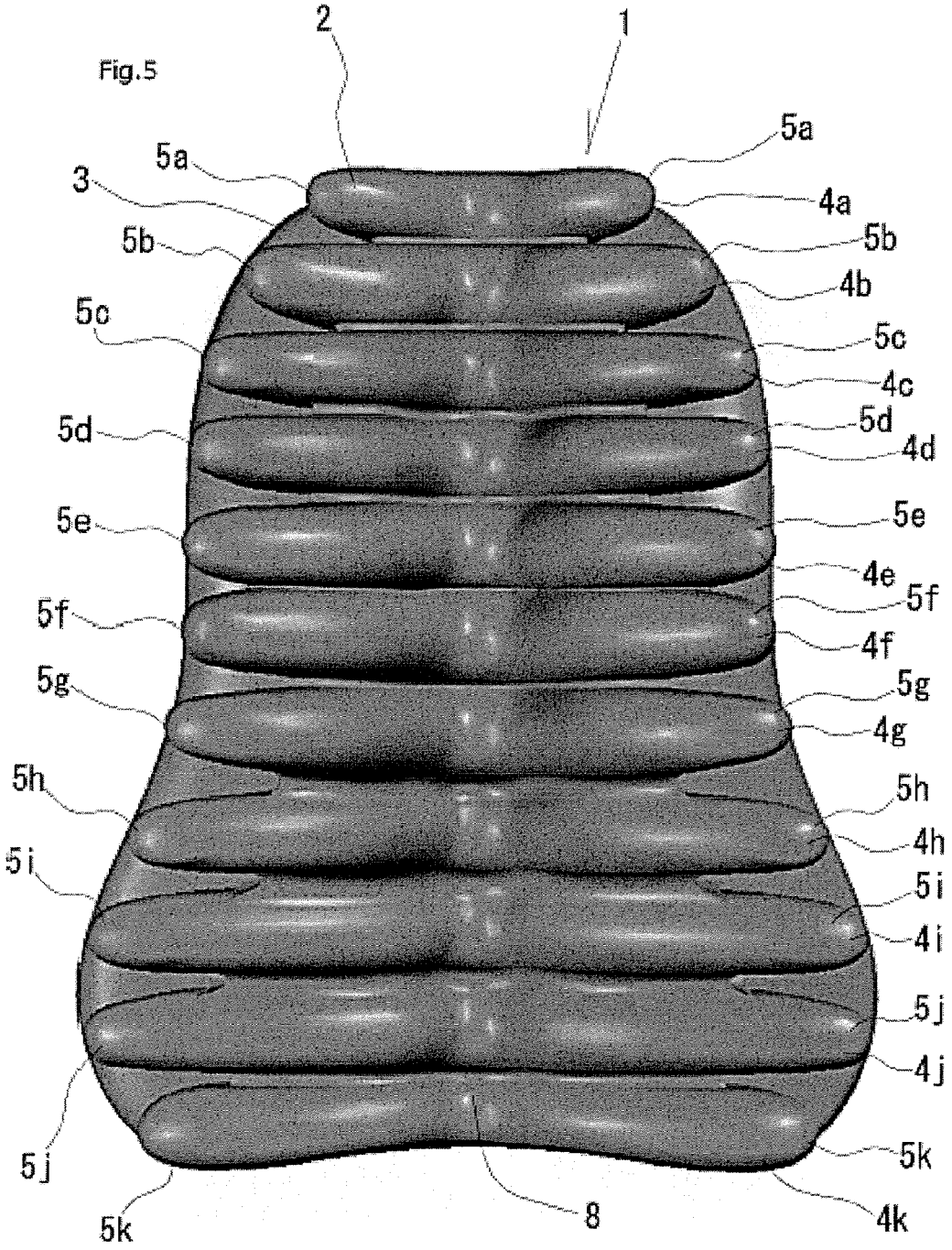
FIG. 5 is a top view of the stretch exercise tool 1.

More specifically, the stretch exercise tool 1 is equipped with a base seat 3 to be set on a floor surface, 11 ribs 4*a* to 4*k* are formed on the base seat 3. As illustrated in FIG. 4, the base seat 3 is a plate part that curves and projects into a crest shape along the longitudinal direction. In the base seat 3, both a front end and a rear end are ground contact parts 6, 6 which are brought into contact with a floor surface, etc., and an arc-shaped part between the ground contact parts 6, 6 is a non-ground contact part 7 spaced from the floor surface, etc.

The 11 ribs 4*a* to 4*k* are formed by sets of right and left finger-like resilient parts 5*a* to 5*k*, respectively. The finger-like resilient parts 5*a* to 5*k* are long thin elastic parts having an almost circular cross section like a finger. Each set of the finger-like resilient parts 5*a* to 5*k* expands symmetrically to upper right and upper left from the center part of the width direction of the base seat 3, thereby forming each piece of approximately V-shaped ribs 4*a* to 4*k* when viewed from the front. Then, 11 sets of right and left finger-like resilient parts 5*a* to 5*k* are arranged at nearly constant intervals in the longitudinal direction, thereby forming the stretching part 2 composed of 11 ribs 4*a* to 4*k*. Further, the ribs 4*a* to 4*k* having approximately V-shapes when viewed from the front are arranged in the longitudinal direction, thereby forming an escaping valley part 8 of the longitudinal direction throughout a center part of the width direction of the stretching part 2.

The stretch exercise tool 1 of the present embodiment is an integrally molded article made of an elastic material such as synthetic rubber and, as described below, is configured in such a manner that the finger-like resilient parts 5*a* to 5*k* can be deflected due to a load at the time when the neck N is placed on the stretching part 2.

Figure 6:
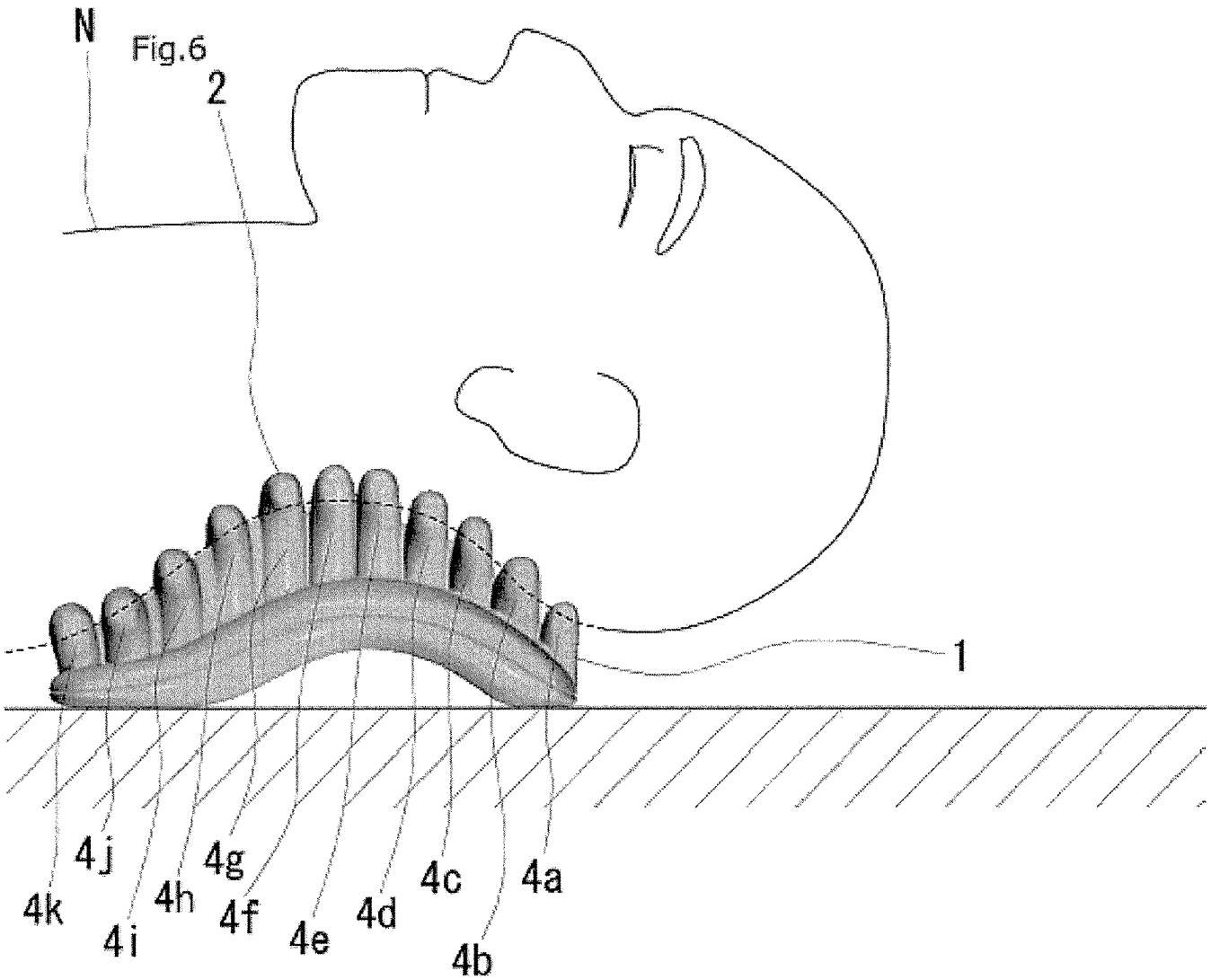
FIG. 6 illustrates a state of use of the stretch exercise tool 1.

The stretch exercise tool 1 of the present embodiment is used by placing it on a floor, etc. in such a manner that a user lies on his back to position a rear side of his neck N on the stretching part 2 in a manner as illustrated in FIG. 6. More specifically, the neck N is placed on the stretching part 2 along the longitudinal direction with the user's head positioned forward of the stretch exercise tool 1 and with the user's shoulder positioned rearwards of the stretch exercise tool 1, and further with the cervical vertebra positioned right above the escaping valley part 8 of the stretching part 2. Then, the rear side of the neck N is caused to be curved along the curved shape of the stretching part 2 by the load of body.

Figure 7:
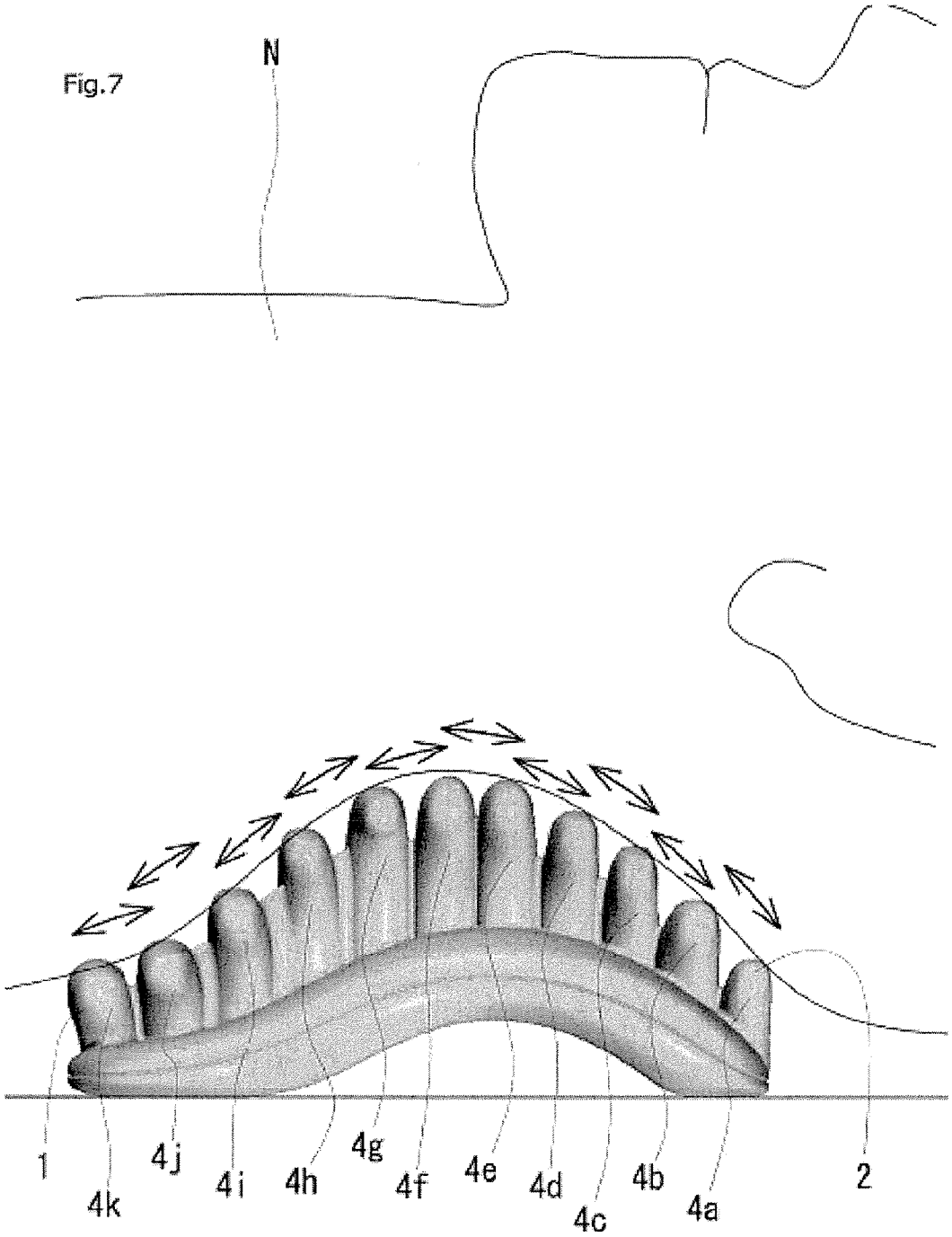
FIG. 7 illustrates an acting state of the stretch exercise tool 1.

Here, in the present embodiment, the stretching part 2 has such a configuration that 11 ribs 4*a* to 4*k* expanding in the width direction are parallelly arranged in the longitudinal direction. Therefore, as illustrated in FIG. 7, when the neck N is placed on the stretching part 2, the ribs 4*a* to 4*k* press the rear side of the neck N at intervals in the longitudinal direction. Accordingly, a force of extending the neck N in the longitudinal direction is topically applied to the rear side of the neck N between body parts pressed by the longitudinally neighboring two ribs 4*a* to 4*k*. As described above, in the present embodiment, when the neck N is placed on the stretching part 2, a force of extending the neck N in the longitudinal direction acts individually on each interval between the first and the second ribs 4*a*, 4*b*, between the second and the third ribs 4*b*, 4*c*, . . . , between the ninth and the tenth ribs 4*i*, 4*j*, and between the tenth and the eleventh ribs 4*j*, 4*k*, so that an inflexible unstretching body part of the neck N and a flexible stretching body part of the neck N can be extended by the individually applied force. Therefore, in the present embodiment, the inflexible body part of the neck N can be effectively extended in comparison with the conventional configurations. More specifically, the neck N can be extended uniformly.

Specifically, in the present embodiment, the number of ribs 4*a* to 4*k* is about 10 (5 to 15). With the configuration, a body part to be placed on the stretching part 2 can be suitably classified in the longitudinal direction and an extending force can be individually applied to an inflexible body part and a flexible body part of the neck N. Further, the rear side of the neck N is suitably pressed by each of the ribs 4*a* to 4*k* to allow a suitable extending force to act on each interval among body parts pressed by the ribs 4*a* to 4*k*.

Figure 8:
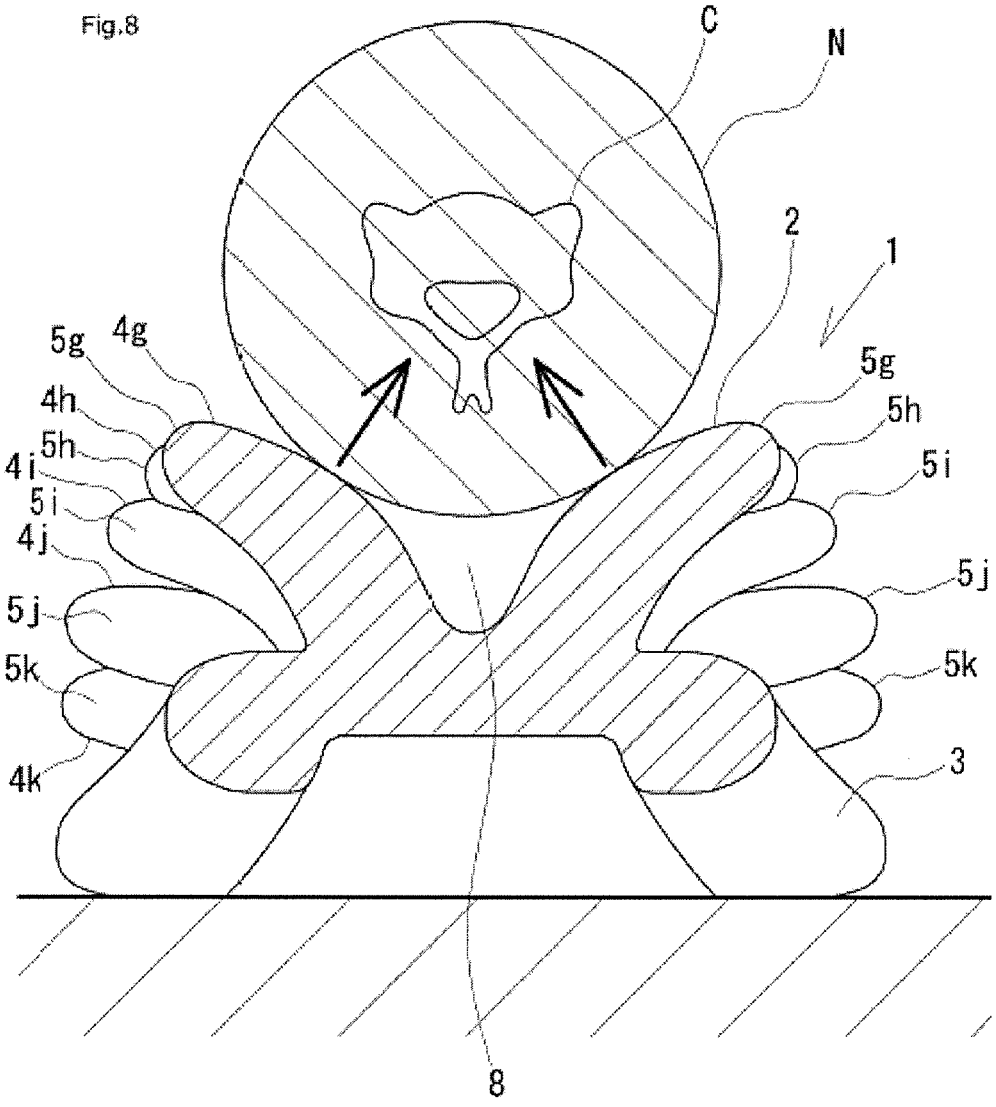
FIG. 8 illustrates another acting state of the stretch exercise tool 1.

Further, in the present embodiment, as illustrated in FIGS. 1 to 5, each of the ribs 4*a* to 4*k* has an approximately V-shape when viewed from the front, and the escaping valley part 8 of the longitudinal direction is formed throughout the center part of the width direction of the ribs 4*a* to 4*k*. Since the escaping valley part 8 faces to the back of the vertebra (cervical vertebra) C when the neck N is placed on the stretching part 2, as illustrated in FIG. 8, there is an advantage that the ribs 4*a* to 4*k* would not contact with the scrawny part behind the vertebra C and thus the vertebra C is hardly susceptible to damage caused by the pressing of the ribs 4*a* to 4*k*. Further, as illustrated in FIG. 8, the approximately V-shaped ribs 4*a* to 4*k* serve not only to press the neck N upwards but also to press the rear side of the neck N in such a manner that the rear side of the neck N is sandwiched from the both sides to be pressed inwardly and upwardly. Therefore, there is another advantage that the ribs 4*a* to 4*k* can cause the extending force to preferably act on muscle around the vertebra C lying through the center of the neck N.

Figure 9:
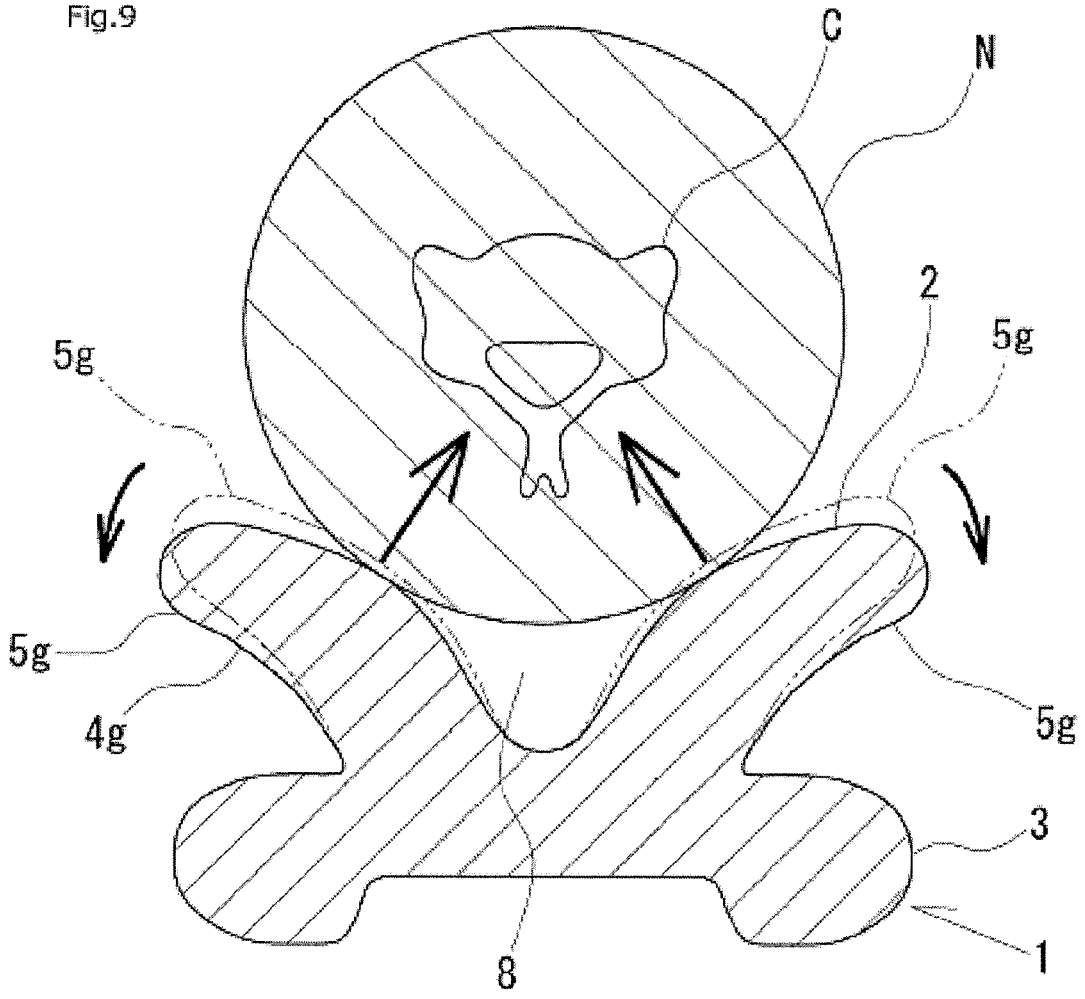
FIG. 9 illustrates a deflected state of a set of finger-like resilient parts 5*g*.

Specifically, in the present embodiment, ribs 4*a* to 4*k* composed of sets of right and left flexible finger-like resilient parts 5*a* to 5*k*, respectively, are formed into an approximately V-shape when viewed from the front. Therefore, as illustrated in FIG. 9, when the neck N is placed on the stretching part 2, the approximately V-shaped rib 4*g* is deflected to be expanded to the right and left direction. Therefore, in the present embodiment, when the neck N is placed on the stretching part 2, the rear side of the neck N can be strongly pressed from the both sides inwardly and upwardly by a restoring elastic force of the finger-like resilient parts 5*a* to 5*k*. This produces an advantage that the muscle around the vertebra C can be more effectively extended.

Figure 10:
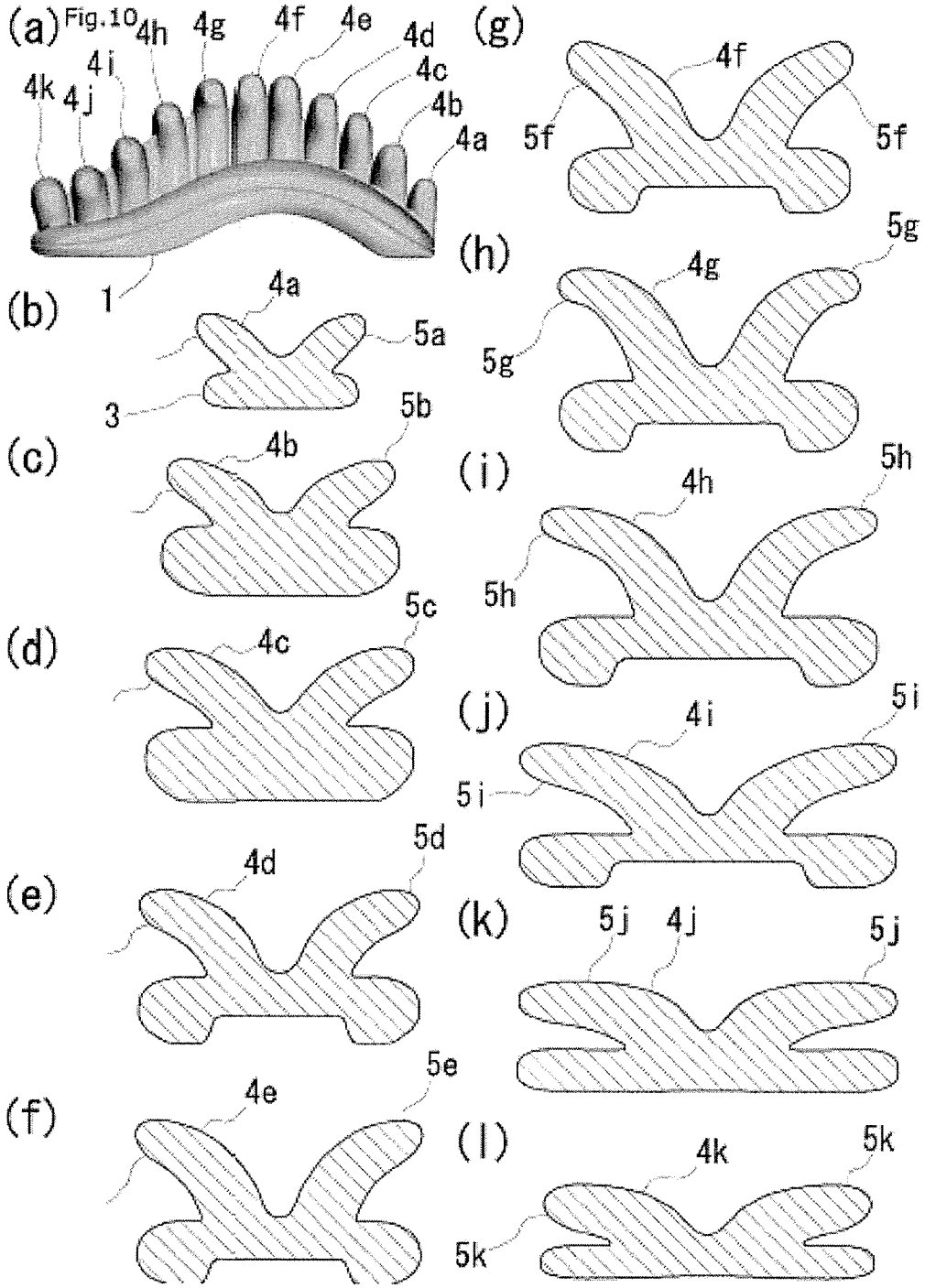
FIG. 10(*a*) is a side view of the stretch exercise tool 1, and FIGS. 10(*b*) to 10(*l*) are end elevational views when the stretch exercise tool 1 is cut vertically at positions of ribs 4*a* to 4*k*, respectively. (explanation of claim 3)

Further, in the present embodiment, as illustrated in FIGS. 9 and 10, the finger-like resilient parts 5*a* to 5*k* curve in an arch shape when viewed from the front, while incline gradually less toward the tip sides thereof. With the shape, as the approximately V-shaped ribs 4*a* to 4*k* are deflected to be expanded to the right and left direction due to the load of the neck N, the relatively steeply inclined base side parts of the finger-like resilient parts 5*a* to 5*k* receive the load to support the neck N. Therefore, even in a case where the finger-like resilient parts 5*a* to 5*k* are largely deflected, an angle made by a contact between the ribs 4*a* to 4*k* and the rear side of the neck N would not change largely. This produces an advantage that an extending force to be acted on the neck N can be constantly applied.

Further, as illustrated in FIG. 10, in the present embodiment, the finger-like resilient parts 5*e* to 5*g*, respectively, forming the ribs 4*e* to 4*g* which are disposed on the center portion of the longitudinal direction are configured to be inclined more steeply when viewed from the front in comparison with the finger-like resilient parts 5*a* to 5*d* and 5*h* to 5*k*, respectively, forming the ribs 4*a* to 4*d* and 4*h* to 4*k*, respectively, disposed on the front side portion and the rear side portion. The finger-like resilient parts 5*e* to 5*g* disposed on the center portion of the longitudinal direction serve to form the ribs 4*e* to 4*g* of the top of the stretching part 2, and thus receive a larger load in comparison with the finger-like resilient parts 5*a* to 5*d* and 5*h* to 5*k*, respectively, disposed on the front side portion and the rear side portion, resulting in being deflected largely. However, in such configuration, since the finger-like resilient parts 5*e* to 5*g* of the center portion are preliminary formed to be inclined steeply, the ribs 4*e* to 4*g* disposed on the center portion and the neck N can contact at a suitable angle even when the finger-like resilient parts 5*e* to 5*g* are deflected largely due to the load of the neck N.

Figure 11:
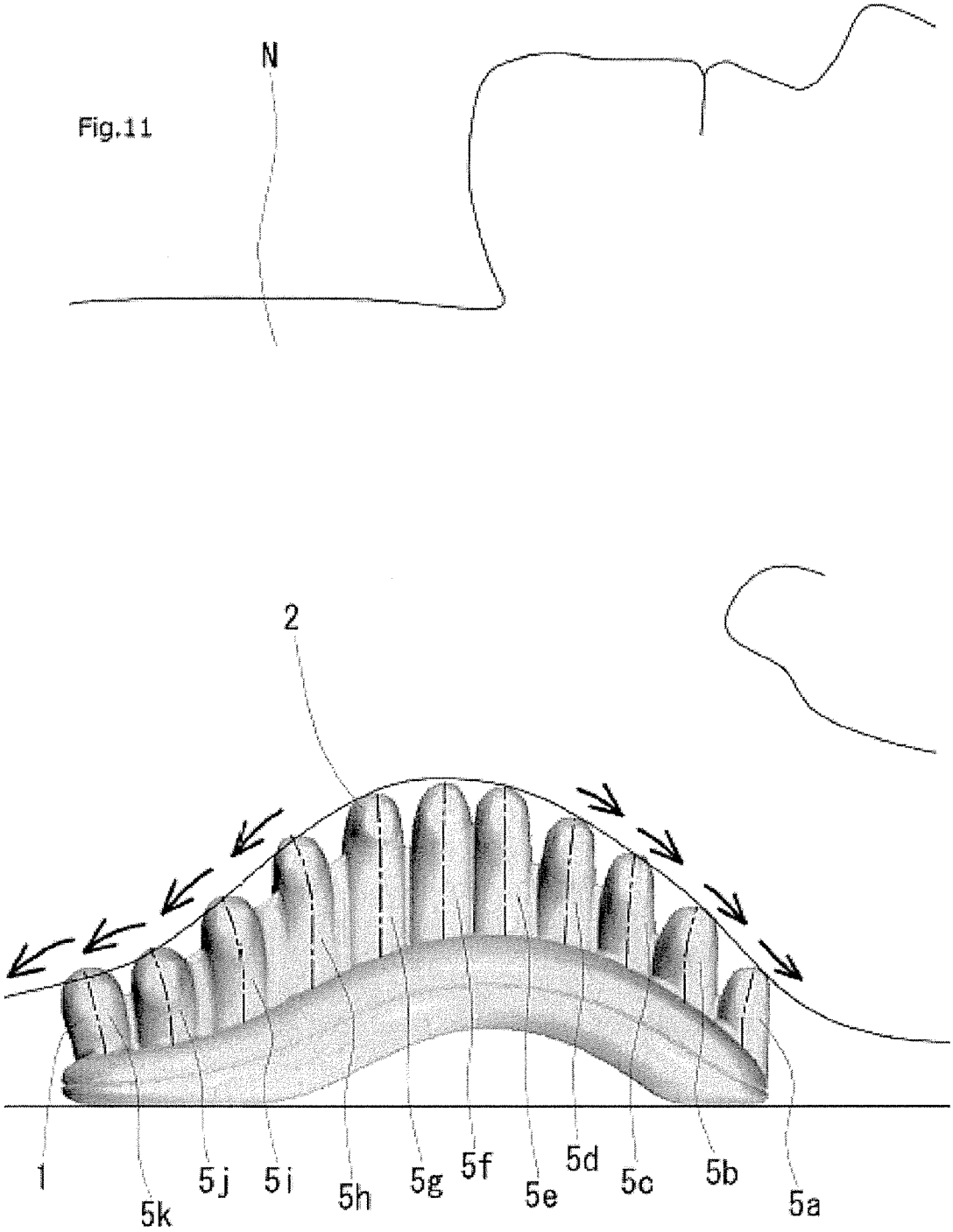
FIG. 11 illustrates further another acting state of the stretch exercise tool 1.

Further, as illustrated in FIG. 11, in the present embodiment, the finger-like resilient parts 5*a* to 5*d*, respectively, forming the ribs 4*a* to 4*d* disposed on the front side portion forwardly incline at about 5 to 15 degrees, and the finger-like resilient parts 5*h* to 5*k*, respectively, forming the ribs 4*h* to 4*k* disposed on the rear side portion rearwardly incline at about 5 to 15 degrees. Therefore, in the present embodiment, when the neck N is placed on the stretching part 2, the finger-like resilient parts 5*a* to 5*d* of the front side portion are deflected to be inclined further forwardly and the finger-like resilient parts 5*h* to 5*k* of the rear side portion are deflected to be inclined further rearwardly due to the load of the neck N. This produces an advantage that the neck N can be further extended in the longitudinal direction of the stretching part 2.

Incidentally, the stretch exercise tool of the present invention is not limited to the embodiment of the above exemplary embodiment but various changes can be applied thereto without departing from the spirit of the present invention.

For example, in the stretch exercise tool 1 of the above described embodiment, the base seat 3 and the ribs 4*a* to 4*k* (finger-like resilient parts 5*a* to 5*k*) are integrally formed but the base seat 3 and the ribs 4*a* to 4*k* can be composed of different members. Further, in the above described embodiment, the stretching part 2 is composed of 11 ribs 4*a* to 4*k*; however, the number of ribs 4*a* to 4*k* is not limited to 11 but can be increased/decreased within an appropriate range. More specifically, the desirable number of ribs 4*a* to 4*k* is 5 to 15. With four or less ribs, it becomes difficult to apply an extending force topically to the inflexible unstretching body part of the neck N. With 16 or more ribs, a load disperses among many ribs and thus a force of pressing the body by each of the ribs 4*a* to 4*k* comes to be insufficient. Further, in the above described embodiment, longitudinally neighboring finger-like resilient parts 5*a* to 5*k* are almost separated from one another but it is not necessary for the neighboring finger-like resilient parts 5*a* to 5*k* to be completely separated one another. Further, in the above described embodiment, the deflecting state of the finger-like resilient parts 5*a* to 5*k* as illustrated in FIG. 9 is a mere example, and thus the deflecting state of the finger-like resilient parts of the present invention may be larger or smaller than the deflecting state illustrated in the above described embodiment.

Further, the stretch exercise tool 1 of the above described embodiment is used by placing the neck N thereon; however, the stretch exercise tool 1 of the present invention is not limited to the use for the neck but is also applicable to the stretch exercise tool that causes muscles around the thoracic vertebra and the lumber vertebra to extend by placing the back or the waist. Incidentally, in using the stretch exercise tool for the use of the back or the waist, a size thereof can be made larger than the stretch exercise tool of the above described embodiment considering a difference in size and shape from those of the neck. Further, it is desirable that the shape is also changed to a shape adaptable to the back or the waist without departing from the spirit of the present invention. Also, in a case where the stretch exercise tool is used for the back or the waist, the stretch exercise tool can be used in the way identical to the case where the stretch exercise tool 1 of the above described embodiment is used for the neck. More specifically, the user's back or waist is placed along the longitudinal direction of the stretching part 2 with a user's head side placed forward of the stretch exercise tool and with a user's foot side placed rearwards of the stretch exercise tool, and further with the vertebrae positioned right above the escaping valley part. Then, the rear side of the back or the waist can be curved along the curved shape of the stretching part due to the load of body.

Further, in the stretch exercise tool 1 of the above described embodiment, only a use method in which the body (the neck N) is placed on the stretch exercise tool 1 set on a floor surface is explained, but the stretch exercise tool of the present invention can be used by methods other than the above described method. For example, it can be used in such a manner that, while the user lies on his face, the other person pushes the stretch exercise tool 1 against the back side of the user's body. Alternatively, the user can use the stretch exercise tool in such a manner that the user holds the stretch exercise tool in his hands to press it against the back side of his body. Further alternatively, the user can use the stretch exercise tool in such a manner that, while the user sits on a chair where the stretch exercise tool is set on a back seat of the chair, the user makes the neck, the back, the waist, etc. lean on the stretch exercise tool set on the back seat of the chair.

REFERENCE SIGNS LIST

1: stretch exercise tool
2: stretching part
3: base seat
4*a* to 4*k*: ribs
5*a* to 5*k*: finger-like resilient parts
6: ground contact part
7: non-ground contact part
8: escaping valley part
C: cervical vertebra (vertebrae)
N: neck

The invention claimed is:

1. A stretch exercise tool comprising:

a stretching part having an upper face, that curves and projects into a crest shape along a longitudinal direction and on which a user's body is placed facing upwards to extend the user's body; and a base seat curving and projecting into the crest shape along the longitudinal direction, wherein the stretching part comprises a plurality of ribs arranged in the longitudinal direction, the plurality of ribs expanding in a width direction, to support the user's body, wherein each of the plurality of ribs is formed by a set of right and left finger-like resilient parts symmetrically expanding to an upper left and an upper right from a center part of a width direction of an upper face of the base seat, and wherein the set of right and left finger-like resilient parts forming the plurality of ribs disposed on a center portion of the longitudinal direction is steeply inclined when viewed from front in comparison with the set of right and left finger-like resilient parts forming the plurality of ribs disposed on a front side portion and on a rear side portion.

2. The stretch exercise tool according to claim 1, wherein the plurality of ribs comprises 5 to 15 ribs.

3. The stretch exercise tool according to claim 1, wherein the plurality of ribs is formed into approximately V-shapes when viewed from a front of the stretch exercise tool.

4. The stretch exercise tool according to claim 1, wherein the set of right and left finger-like resilient parts is curved in an arc-shape loosely inclined toward tip sides thereof when viewed from a front of the stretch exercise tool.

5. The stretch exercise tool according to claim 1, wherein the set of right and left finger-like resilient parts forming the plurality of ribs disposed on the front side portion is inclined forward and the set of right and left finger-like resilient parts forming the plurality of ribs disposed on the rear side portion is inclined rearwards.

6. A stretch exercise tool comprising:

a stretching part having an upper face, that curves and projects into a crest shape along a longitudinal direction and on which a user's body is placed facing upwards to extend the user's body; and a base seat curving and projecting into the crest shape along the longitudinal direction, wherein the stretching part comprises a plurality of ribs arranged in the longitudinal direction, the plurality of ribs expanding in a width direction, to support the user's body, wherein each of the plurality of ribs is formed by a set of right and left finger-like resilient parts symmetrically expanding to an upper left and an upper right from a center part of a width direction of an upper face of the base seat, and, wherein the set of right and left finger-like resilient parts forming the plurality of ribs disposed on a front side portion is inclined forward and the set of right and left finger-like resilient parts forming the plurality of ribs disposed on a rear side portion is inclined rearwards.

7. The stretch exercise tool according to claim 6, wherein the plurality of ribs is formed into approximately V-shapes when viewed from a front of the stretch exercise tool.

8. The stretch exercise tool according to claim 6, wherein the set of right and left finger-like resilient parts forming the plurality of ribs disposed on a center portion of the longitudinal direction is steeply inclined when viewed from a front of the stretch exercise tool in comparison with the set of right and left finger-like resilient parts forming the plurality of ribs disposed on the front side portion and on the rear side portion.

9. The stretch exercise tool according to claim 6, wherein the plurality of ribs comprises 5 to 15 ribs.

10. The stretch exercise tool according to claim 6, wherein the set of right and left finger-like resilient parts is curved in an arc-shape loosely inclined toward tip sides thereof when viewed from a front of the stretch exercise tool.

* * * * *